US011549069B1

(12) United States Patent
Koseoglu

(10) Patent No.: US 11,549,069 B1
(45) Date of Patent: Jan. 10, 2023

(54) TWO-PHASE HYDROPROCESSING UTILIZING SOLUBLE HYDROGEN FROM THE HIGH PRESSURE SEPARATOR

(71) Applicant: Saudi Arabian Oil Company, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/580,237

(22) Filed: Jan. 20, 2022

(51) Int. Cl.
*C10G 45/04* (2006.01)
*C10G 65/04* (2006.01)

(52) U.S. Cl.
CPC ..... *C10G 45/04* (2013.01); *C10G 65/04* (2013.01); *C10G 2300/107* (2013.01); *C10G 2300/1074* (2013.01); *C10G 2300/202* (2013.01); *C10G 2300/205* (2013.01); *C10G 2400/04* (2013.01)

(58) Field of Classification Search
CPC ..... C10G 2300/202; C10G 2300/205; C10G 2400/04; C10G 45/04; C10G 65/04; C10G 2300/107; C10G 2300/1074
See application file for complete search history.

(56) References Cited

U.S. PATENT DOCUMENTS

| | | | | |
|---|---|---|---|---|
| 6,428,686 | B1 | 8/2002 | Ackerson et al. | |
| 6,623,622 | B2 | 9/2003 | Gupta | |
| 6,740,226 | B2 | 5/2004 | Mehra et al. | |
| 8,008,534 | B2 * | 8/2011 | Petri | C10G 49/26 208/46 |
| 8,940,155 | B2 | 1/2015 | Koseoglu | |
| 8,951,406 | B2 | 2/2015 | Koseoglu | |
| 9,365,781 | B2 | 6/2016 | Dindi | |
| 11,208,600 | B2 | 12/2021 | Huang et al. | |
| 11,312,912 | B2 | 4/2022 | Koseoglu | |

* cited by examiner

*Primary Examiner* — Randy Boyer
*Assistant Examiner* — Juan C Valencia
(74) *Attorney, Agent, or Firm* — Dinsmore & Shohl, LLP

(57) ABSTRACT

A process for hydroprocessing a hydrocarbon feed of the present disclosure includes contacting the hydrocarbon feed with hydrogen in the presence of at least one hydroprocessing catalyst in a two-phase hydroprocessing unit, where the at least one hydroprocessing catalyst is a solid catalyst and contacting produces a hydroprocessed effluent having a reduced concentration of one or more of metals, nitrogen, sulfur, aromatic compounds, or combinations of these. The process further includes combining the hydroprocessed effluent with make-up hydrogen downstream of the two-phase hydroprocessing unit to produce a hydrogen saturated hydroprocessed effluent, separating the hydrogen saturated hydroprocessed effluent in a separation system to produce a hydrogen-saturated high-pressure bottom stream, a hydroprocessed product stream, and a gaseous effluent, and passing at least a portion of the hydrogen-saturated high-pressure bottom stream back to the two-phase hydroprocessing unit.

20 Claims, 4 Drawing Sheets

TWO-PHASE HYDROPROCESSING UTILIZING SOLUBLE HYDROGEN FROM THE HIGH PRESSURE SEPARATOR

TECHNICAL FIELD

Embodiments of the present disclosure generally relate to processes and systems for hydroprocessing a hydrocarbon feed to produce a transportation fuel.

BACKGROUND

Hydroprocessing technologies, such as hydrotreating, hydrocracking, or both, are commonly used in the industry to produce value added products from crude oils and its fractions. Hydrotreating may remove heteroatoms, such as sulfur, nitrogen, oxygen, or combinations thereof, from a hydrocarbon feedstock. During the hydrotreating processes, unsaturated hydrocarbons, such as olefins, alkynes, aromatics, or combinations thereof, may become saturated through a reaction with hydrogen. Hydrotreating processes are performed in the presence of a hydrotreating catalyst at elevated temperatures and pressures. Hydrocracking processes may split the low value heavy molecules of the feed into smaller molecules having higher average volatility and greater economic value compared to the low value heavy molecules. Additionally, hydrocracking processes typically improve the quality of the hydrocarbon feedstock by increasing the hydrogen to carbon ratio and by removing organosulfur and organonitrogen compounds. The significant benefit derived from hydrocracking operations has resulted in substantial development of process improvements and more active catalysts.

A key use of hydroprocessing is in the desulfurization of fuel fractions, such as diesel. Production of ultra-low sulfur level fuels requires removal of sulfur-containing compounds, such as hindered alkylated dibenzothiophenes, which is challenging. Hydrodesulfurization of sulfides, disulfides, thiophenes, benzothiophenes and dibenzothiophenes takes place by breaking the carbon sulfur bond directly. However, the sulfur atoms of alkylated dibenzothiophenes are severely sterically hindered by the two adjacent alkyl groups. Thus, the sulfur cannot be removed by direct carbon-sulfur bond breakage. Instead, one of the aromatic rings in the molecule is required to be first dearomatized (hydrogenated) in order to make the sulfur atom reachable. After hydrogenation, the carbon-sulfur bond is broken and the sulfur is removed from the molecule. These processes require extremely severe operating conditions that either requires a lower space velocity of the feed flow that, in turn, decreases the production capacity of the unit, or, an increase the reaction temperature, which can shorten the useful life of the catalyst.

Conventional hydrodesulfurization methods generally utilize a single reactor consisting of three-phases: gas-hydrogen, liquid-feedstock and solid-catalyst. Conventional hydrodesulfurization processes, which are used worldwide, take place in one step in a single three phase reactor. In particular, in the reactor, the mixed two-phase feedstock may flow in the reactor in a down flow direction. The reactants inside the reactor are liquid feedstock, gas phase hydrogen and solid phase catalyst, making the reactor a three-phase reactor, which may be referred to as a trickle bed reactor. The term "trickle bed reactor" may refer a reactor in which a liquid phase and a gas phase flow concurrently downward through a fixed bed of catalyst particles while reaction takes place. In the trickle bed reactor, the reactor bed may be fixed, the flow pattern may be much closer to plug flow, and the ratio of liquid to solid present may be much less. Fluid flowing through the reactor may be considered as a series of infinitely thin coherent plugs, each with a uniform composition, traveling in the axial direction of the reactor, with each plug having a different composition from the ones before and after it. The fluid may be mixed well in the radial direction but not in the axial direction. In the reactor, the hydrogen gas may be transported from the gas phase to the liquid phase, across the gas/liquid interphase. Hydrogen may then be transported through the liquid to the external surface of the catalyst particles and then to the interior of the catalyst particle. Hydrogen gas may adsorb at an active site on the catalyst surface and reacts with the hydrocarbon molecules, which may be also adsorb on the active site. Reactions are taking place in the liquid phase. As soon as the hydrogen in the liquid phase is consumed, more hydrogen may be transported to the liquid phase since there is still large amount gas phase hydrogen in the system. Liquid molecules have simple behavior, since it is in the liquid state. The liquid molecules may be transported to the external surface of the catalyst and then diffuse into the pores of the solid catalyst. Liquid products are required to diffuse from the interior of the catalyst to the external surface and then be transported from the external surface to the bulk liquid. In the reactor, sulfur and nitrogen may be removed from hydrocarbons by forming $H_2S$ and $NH_3$.

SUMMARY

Despite conventional hydroprocessing processes being available for hydroprocessing hydrocarbon feeds, these conventional three-phase hydroprocessing processes require at least two high capacity compressors, such as a make-up hydrogen compressor and a recycle hydrogen compressor, and other additional equipment. Compression of the make-up and recycle hydrogen streams consume a great deal of energy.

Accordingly, there is an ongoing need for systems and processes to hydroprocess hydrocarbon feeds to produce hydroprocessed product streams having increased yields of transportation fuel fractions, such as diesel fractions, while reducing compressor capacity and power and capacity of other additional equipment. These needs are met by embodiments of the systems and processes for hydroprocessing hydrocarbon feeds described in the present disclosure. The processes of the present disclosure include contacting the hydrocarbon feed with hydrogen in the presence of at least one solid hydroprocessing catalyst in a two-phase hydroprocessing unit, combining the hydroprocessed effluent with make-up hydrogen downstream of the two-phase hydroprocessing unit to produce a hydrogen-saturated hydroprocessed effluent, and separating the hydrogen-saturated hydroprocessed effluent in a separation system to produce a hydrogen-saturated high-pressure bottom stream, a hydroprocessed product stream, and a gaseous effluent. The hydrogen-saturated high-pressure bottom stream is saturated with hydrogen dissolved into a liquid phase. The process of the present disclosure further includes passing at least a portion of the hydrogen-saturated high-pressure bottom stream back to the two-phase hydroprocessing unit, where the hydrogen-saturated high-pressure bottom stream provides at least 70% of the hydrogen in the two-phase hydroprocessing unit. The systems and processes of the present disclosure utilize two-phase hydroprocessing with recycling hydrogen stream. Accordingly, the systems and processes of the present disclosure reduce hydrogen consumption and recycle hydrogen compression. The systems and processes of the present disclosure may also increase yields of transportation fuels, such as but not limited to diesel fuel containing less than or equal to 50 parts per million weight (ppmw) sulfur, low-sulfur diesel fuel containing less than or equal to 10 ppmw sulfur, or other gasoline pool components.

According one or more aspects of the present disclosure, a process for hydroprocessing a hydrocarbon feed includes contacting the hydrocarbon feed with hydrogen in the presence of at least one solid hydroprocessing catalyst in a two-phase hydroprocessing unit, where contacting produces a hydroprocessed effluent having a reduced concentration of one or more of metals, nitrogen, sulfur, aromatic compounds, or combinations of these compared to the hydrocarbon feed. The process further includes combining the hydroprocessed effluent with make-up hydrogen downstream of the two-phase hydroprocessing unit to produce a hydrogen-saturated hydroprocessed effluent and separating the hydrogen-saturated hydroprocessed effluent in a separation system to produce a hydrogen-saturated high-pressure bottom stream, a hydroprocessed product stream, and a gaseous effluent, wherein the hydrogen-saturated high-pressure bottom stream is saturated with hydrogen dissolved into a liquid phase. The process further includes passing at least a portion of the hydrogen-saturated high-pressure bottom stream back to the two-phase hydroprocessing unit, where the hydrogen-saturated high-pressure bottom stream can provide at least 70% of the hydrogen in the two-phase hydroprocessing unit According one or more other aspects of the present disclosure, a system for hydroprocessing a hydrocarbon feed to produce a transportation fuel comprises a two-phase hydroprocessing unit comprising at least one solid hydroprocessing catalyst, where the two-phase hydroprocessing unit is operable to contact the hydrocarbon feed with hydrogen in the presence the at least one solid hydroprocessing catalyst to produce a hydroprocessed effluent having a reduced concentration of one or more of metals, nitrogen, sulfur, aromatic compounds, or combinations of these compared to the hydrocarbon feed. The system can further include a make-up hydrogen stream in fluid communication with the hydroprocessed effluent, where the make-up hydrogen stream is combined with the hydroprocessed effluent downstream of the two-phase hydroprocessing unit to produce a hydrogen-saturated hydroprocessed effluent. The system can include a separation system downstream of the two-phase hydroprocessing unit, where the separation system is operable to separate the hydrogen-saturated hydroprocessed effluent to produce a hydrogen-saturated high-pressure bottom stream, a hydroprocessed product stream, and a gaseous effluent. The hydrogen-saturated high-pressure bottom stream can be saturated with hydrogen dissolved into a liquid phase. The system can further include a bottom stream recycle line fluidly coupled to the separation system and to an inlet of the two-phase hydroprocessing unit, where the bottom stream recycle line is operable to pass at least a portion of the hydrogen-saturated high-pressure bottom stream from the separation system to the two-phase hydroprocessing unit. The hydrogen-saturated high-pressure bottom stream can provide at least 70% of the hydrogen in the two-phase hydroprocessing unit.

Additional features and advantages of the described embodiments will be set forth in the detailed description which follows, and in part will be readily apparent to those skilled in the art from that description or recognized by practicing the described embodiments, including the detailed description which follows as well as the drawings and the claims.

BRIEF DESCRIPTION OF THE DRAWINGS

The following detailed description of specific aspects of the present disclosure can be best understood when read in conjunction with the following drawings, in which like structure is indicated with like reference numerals and in which.

Figure 1:
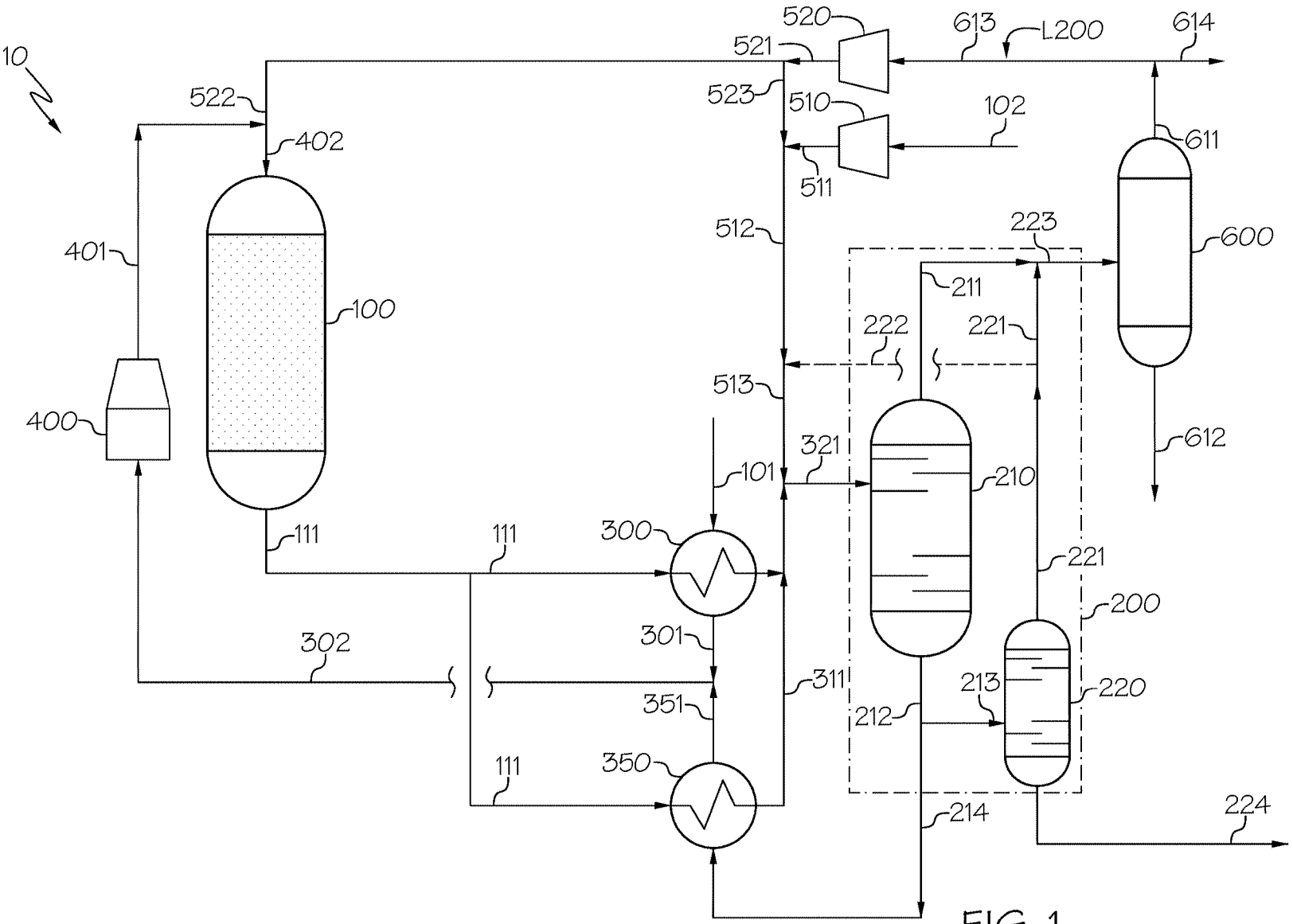
FIG. 1 schematically depicts a generalized flow diagram of a system for hydroprocessing a hydrocarbon feed, according to one or more embodiments shown and described in the present disclosure.

For the purpose of describing the simplified schematic illustrations and descriptions of the relevant figures, the numerous valves, temperature sensors, electronic controllers and the like that may be employed and well known to those of ordinary skill in the art of certain chemical processing operations are not included. Further, accompanying components that are often included in typical chemical processing operations are not depicted. However, operational components, such as those described in the present disclosure, may be added to the embodiments described in this disclosure.

It should further be noted that arrows in the drawings refer to process streams. However, the arrows may equivalently refer to transfer lines which may serve to transfer process streams between two or more system components. Additionally, arrows that connect to system components define inlets or outlets in each given system component. The arrow direction corresponds generally with the major direction of movement of the materials of the stream contained within the physical transfer line signified by the arrow. Furthermore, arrows which do not connect two or more system components signify a product stream which exits the depicted system or a system inlet stream which enters the depicted system. Product streams may be further processed in accompanying chemical processing systems or may be commercialized as end products. System inlet streams may be streams transferred from accompanying chemical processing systems or may be non-processed feedstock streams. Some arrows may represent recycle streams, which are effluent streams of system components that are recycled back into the system. However, it should be understood that any represented recycle stream, in some embodiments, may be replaced by a system inlet stream of the same material, and that a portion of a recycle stream may exit the system as a system product.

Additionally, arrows in the drawings may schematically depict process steps of transporting a stream from one system component to another system component. For example, an arrow from one system component pointing to another system component may represent "passing" a system component effluent to another system component, which may include the contents of a process stream "exiting" or being "removed" from one system component and "introducing" the contents of that product stream to another system component.

It should be understood that according to the embodiments presented in the relevant figures, an arrow between two system components may signify that the stream is not processed between the two system components. In other embodiments, the stream signified by the arrow may have substantially the same composition throughout its transport between the two system components. Additionally, it should be understood that in one or more embodiments, an arrow may represent that at least 75 wt. %, at least 90 wt. %, at least 95 wt. %, at least 99 wt. %, at least 99.9 wt. %, or even 100 wt. % of the stream is transported between the system components. As such, in some embodiments, less than all of the stream signified by an arrow may be transported between the system components, such as if a slip stream is present.

It should be understood that two or more process streams are "mixed" or "combined" when two or more lines intersect in the schematic flow diagrams of the relevant figures. Mixing or combining may also include mixing by directly introducing both streams into a reactor, separation device, or other system component. For example, it should be understood that when two streams are depicted as being combined directly prior to entering a separation unit or reactor, that in some embodiments the streams could equivalently be introduced into the separation unit or reactor and be mixed in the reactor.

Reference will now be made in greater detail to various aspects of the present disclosure, some aspects of which are illustrated in the accompanying drawings.

DETAILED DESCRIPTION

Embodiments of the present disclosure are directed to processes and systems for hydroprocessing a hydrocarbon feed. The processes of the present disclosure may include contacting the hydrocarbon feed with hydrogen in the presence of at least one solid hydroprocessing catalyst in a two-phase hydroprocessing unit. The contacting may produce a hydroprocessed effluent having a reduced concentration of one or more of metals, nitrogen, sulfur, aromatic compounds, or combinations of these compared to the hydrocarbon feed. The processes of the present disclosure may further include combining the hydroprocessed effluent with make-up hydrogen downstream of the two-phase hydroprocessing unit to produce a hydrogen saturated hydroprocessed effluent, and separating the hydrogen saturated hydroprocessed effluent in a separation system to produce a hydrogen-saturated high-pressure bottom stream, a hydroprocessed product stream, and a gaseous effluent. The hydrogen-saturated high-pressure bottom stream may be saturated with hydrogen dissolved into a liquid phase. The processes of the present disclosure may further include passing at least a portion of the hydrogen-saturated high-pressure bottom stream back to the two-phase hydroprocessing unit. The hydrogen saturated high pressure bottom stream may provide at least 70%, at least 80%, at least 90%, or even at least 95% of the hydrogen in the two-phase hydroprocessing unit. The systems and processes of the present disclosure may reduce hydrogen consumption and recycle gas compression by utilizing two-phase hydroprocessing. The systems and processes of the present disclosure may also increase yields of transportation fuels, such as but not limited to diesel fuel containing less than or equal to 45 parts per million weight (ppmw) sulfur.

As used in this disclosure, a "reactor" refers to any vessel, container, or the like, in which one or more chemical reactions may occur between one or more reactants optionally in the presence of one or more catalysts. For example, a reactor may include a tank or tubular reactor configured to operate as a batch reactor, a continuous stirred-tank reactor (CSTR), or a plug flow reactor. Example reactors include packed bed reactors, such as fixed bed reactors, and fluidized bed reactors. As used in the present disclosure, the term "fixed bed reactor" may refer to a reactor in which a catalyst is confined within the reactor in a reaction zone in the reactor and is not circulated continuously through a reactor and regenerator system.

As used in this disclosure, one or more "reaction zones" may be disposed within a reactor. As used in this disclosure, a "reaction zone" refers to an area in which a particular reaction takes place in a reactor. For example, a packed bed reactor with multiple catalyst beds may have multiple reaction zones, in which each reaction zone is defined by the area of each catalyst bed.

As used in this disclosure, a "separation unit" refers to any separation device that at least partially separates one or more chemicals in a mixture from one another. For example, a separation unit may selectively separate different chemical species from one another, forming one or more chemical fractions. Examples of separation units include, without limitation, distillation columns, fractionators, flash drums, knock-out drums, knock-out pots, centrifuges, filtration devices, traps, scrubbers, expansion devices, membranes, solvent extraction devices, high-pressure separators, low-pressure separators, and the like. It should be understood that separation processes described in this disclosure may not completely separate all of one chemical constituent from all of another chemical constituent. It should be understood that the separation processes described in this disclosure "at least partially" separate different chemical components from one another, and that even if not explicitly stated, it should be understood that separation may include only partial separation. As used in this disclosure, one or more chemical constituents may be "separated" from a process stream to form a new process stream. Generally, a process stream may enter a separation unit and be divided or separated into two or more process streams of desired composition.

As used in this disclosure, the terms "upstream" and "downstream" refers to the relative positioning of unit operations with respect to the direction of flow of the process streams. A first unit operation of the system may be considered "upstream" of a second unit operation if process streams flowing through the system encounter the first unit operation before encountering the second unit operation. Likewise, a second unit operation may be considered "downstream" of the first unit operation if the process streams flowing through the system encounter the first unit operation before encountering the second unit operation.

As used in the present disclosure, passing a stream or effluent from one unit "directly" to another unit may refer to passing the stream or effluent from the first unit to the second unit without passing the stream or effluent through an intervening reaction system or intervening separation system that substantially changes the composition of the stream or effluent. Heat transfer devices, such as heat exchangers, preheaters, coolers, condensers, or other heat transfer equipment, and pressure devices, such as pumps, pressure regulators, compressors, or other pressure devices, are not considered to be intervening systems that change the composition of a stream or effluent. Combining two streams or effluents together also is not considered to comprise an intervening system that changes the composition of one or both of the streams or effluents being combined. Surge vessels are also not considered to be intervening systems that change the composition of a stream or effluent.

As used in this disclosure, the term "effluent" refers to a stream that is passed out of a reactor, a reaction zone, or a separation unit following a particular reaction or separation. Generally, an effluent has a different composition than the stream that entered the separation unit, reactor, or reaction zone. It should be understood that when an effluent is passed to another system unit, only a portion of that system stream may be passed. For example, a slip stream may carry some of the effluent away, meaning that only a portion of the effluent may enter the downstream system unit. The term "reaction effluent" may more particularly be used to refer to a stream that is passed out of a reactor or reaction zone.

As used in this disclosure, the term "catalyst" refers to any substance that increases the rate of a specific chemical reaction. Catalysts described in this disclosure may be utilized to promote various reactions, such as, but not limited to, steam cracking. However, some catalysts described in the present disclosure may have multiple forms of catalytic activity, and calling a catalyst by one particular function does not render that catalyst incapable of being catalytically active for other functionality.

As used in this disclosure, the term "cracking" generally refers to a chemical reaction where a molecule having carbon-carbon bonds is broken into more than one molecule by the breaking of one or more of the carbon-carbon bonds; where a compound including a cyclic moiety, such as an aromatic compound, is converted to a compound that does not include a cyclic moiety; or where a molecule having carbon-carbon double bonds are reduced to carbon-carbon single bonds.

As used in this disclosure, the term "crude oil" or "whole crude oil" is to be understood to mean a mixture of petroleum liquids, gases, or combinations of liquids and gases, including, in some embodiments, impurities such as but not limited to sulfur-containing compounds, nitrogen-containing compounds, and metal compounds, that have not undergone significant separation or reaction processes. Crude oils are distinguished from fractions of crude oil.

It should further be understood that streams may be named for the components of the stream, and the component for which the stream is named may be the major component of the stream (such as comprising from 50 wt. %, from 70 wt. %, from 90 wt. %, from 95 wt. %, from 99 wt. %, from 99.5 wt. %, or even from 99.9 wt. % of the contents of the stream to 100 wt. % of the contents of the stream). It should also be understood that components of a stream are disclosed as passing from one system component to another when a stream comprising that component is disclosed as passing from that system component to another. For example, a disclosed "hydrogen stream" passing to a first system component or from a first system component to a second system component should be understood to equivalently disclose "hydrogen" passing to the first system component or passing from a first system component to a second system component.

Figure 2:
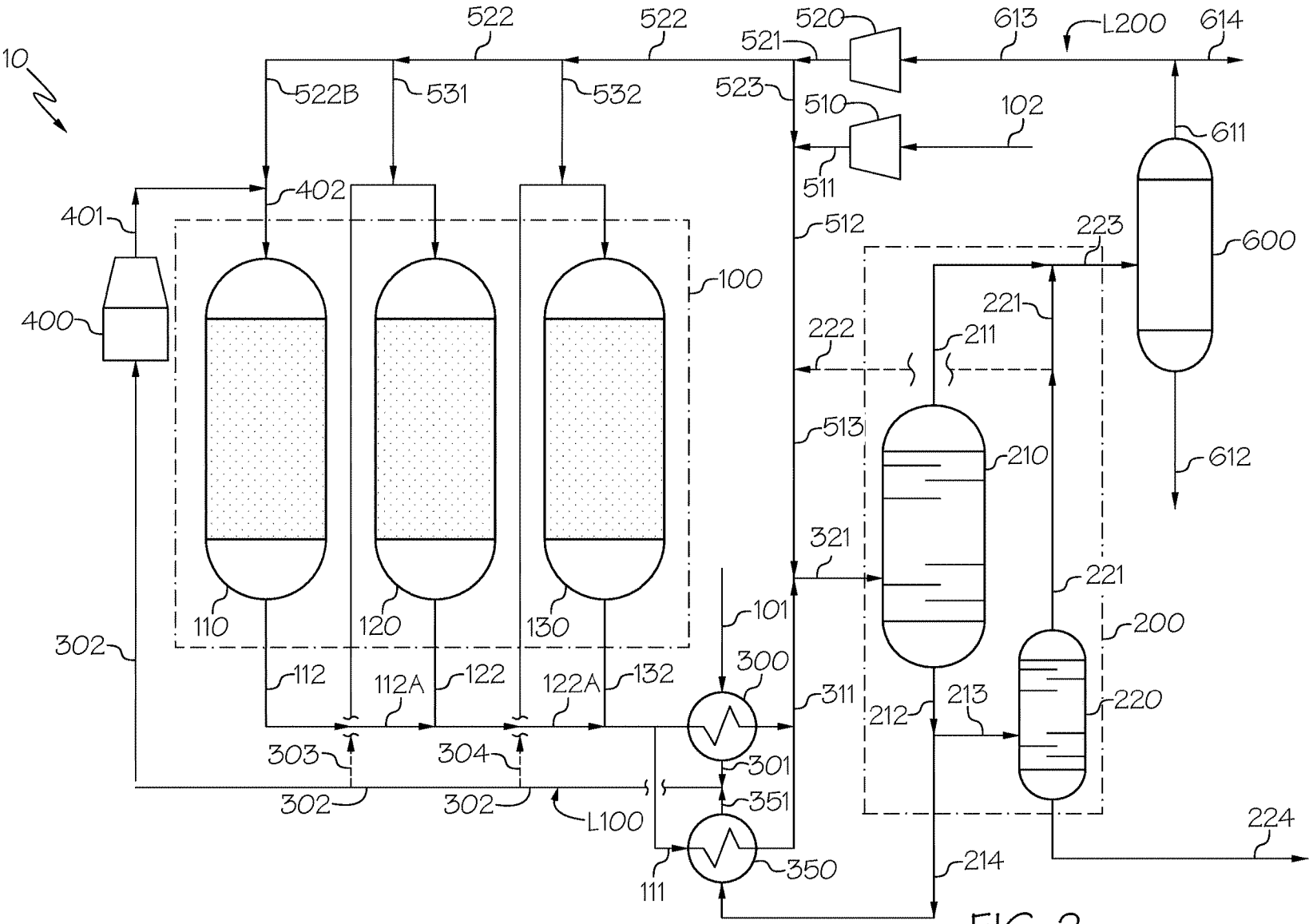
FIG. 2 schematically depicts a generalized flow diagram of a system for hydroprocessing a hydrocarbon feed, according to one or more embodiments shown and described in the present disclosure.

Referring now to FIGS. 1 to 2, a system 10 of the present disclosure for hydroprocessing a hydrocarbon feed stream 101 is schematically depicted. The system 10 generally receives a hydrocarbon feed stream 101 and directly processes the hydrocarbon feed stream 101 to hydroprocess the hydrocarbon feed stream 101. The system 10 may include a two-phase hydroprocessing unit 100 and a separation system 200 disposed downstream of the two-phase hydroprocessing unit 100. The system 10 may further include a first heat exchanger 300, a furnace 400, a make-up hydrogen compressor 510, a recycle hydrogen compressor 520 and a gaseous effluent separation system 600.

Referring again to FIGS. 1 to 2, the hydrocarbon feed stream 101 may include atmospheric distillates or vacuum distillates derived from crude oil, intermediate refinery feedstocks, such as fluid catalytic cracking (FCC) cycle oil, coking product, any other thermal process products, or combinations of these. In embodiments, the hydrocarbon feed stream 101 may comprise an atmospheric distillate, a vacuum distillate, or both. In embodiments, the hydrocarbon feed stream 101 may comprise hydrocarbons boiling in a temperature range of from 36° C. to 565° C., from 36° C. to 550° C., from 36° C. to 500° C., from 36° C. to 450° C., from 36° C. to 425° C., from 36° C. to 400° C., from 50° C. to 565° C., from 50° C. to 550° C., from 50° C. to 500° C., from 50° C. to 450° C., from 50° C. to 425° C., from 50° C. to 400° C., from 100° C. to 565° C., from 100° C. to 550° C., from 100° C. to 500° C., from 100° C. to 450° C., from 100° C. to 425° C., from 100° C. to 400° C., from 150° C. to 565° C., from 150° C. to 550° C., from 150° C. to 500° C., from 150° C. to 450° C., from 150° C. to 425° C., from 150° C. to 400° C., from 370° C. to 565° C., or from 400° C. to 565° C.

The hydrocarbon feed stream 101 may be introduced to the two-phase hydroprocessing unit 100. Additionally, at least a portion of the hydroprocessed effluent 111 may be recycled back to the two-phase hydroprocessing unit 100. In embodiments, the portion of the hydroprocessed effluent 111 recycled back to the two-phase hydroprocessing unit 100 may be a hydrogen-saturated high-pressure bottom stream 212. The hydrogen-saturated high-pressure bottom stream 212 may be introduced to the two-phase hydroprocessing unit 100 or may be combined with the hydrocarbon feed stream 101 upstream of the two-phase hydroprocessing unit 100. The hydrocarbon feed stream 101 may have limited capacity for hydrogen dissolution. Recycling the at least a portion of the hydroprocessed effluent 111 back to the two-phase hydroprocessing unit 100 may provide dissolved hydrogen in the liquid phase to satisfy at least a portion of the hydrogen demand of the hydrogenation reactions. Passing dissolved hydrogen in the liquid phase to the two-phase hydroprocessing unit 100 may increase the yields of transportation fuels, such as but not limited to diesel fuel containing less than or equal to 45 parts per million weight (ppmw), less than or equal to 40 ppmw, less than or equal to 35 ppmw, less than or equal to 30 ppmw, less than or equal to 25 ppmw, less than or equal to 20 ppmw, less than or equal to 15 ppmw, or less than or equal to 10 ppmw, may be increased. Passing dissolved hydrogen in the liquid phase to the two-phase hydroprocessing unit 100 may also reduce compressor capacity required for providing hydrogen to the two-phase hydroprocessing unit 100.

In embodiments, a volume ratio of the hydrocarbon feed stream 101 to the hydrogen-saturated high-pressure bottom stream 212 may be from 1 to 1, from 1 to 3, or from 1 to 10. The amount of the hydrogen-saturated high-pressure bottom stream 212 can be determined from the hydrogen consumption in the two-phase hydroprocessing unit 100. If the hydrogen consumption is high then the recycle rate of the hydrogen-saturated high-pressure bottom stream 212 to the two-phase hydroprocessing unit 100 can be increased to provide more fluids to dissolve hydrogen and provide more hydrogen to the two-phase hydroprocessing unit 100.

The hydrocarbon feed stream 101, the hydrogen-saturated high-pressure bottom stream 212, or both, may be contacted with hydrogen in the presence of at least one solid hydroprocessing catalyst in the two-phase hydroprocessing unit 100 to produce a hydroprocessed effluent 111. The hydrogen in the two-phase hydroprocessing unit 100 may be provided mainly by the hydrogen-saturated high-pressure bottom stream 212. In embodiments, the hydrogen-saturated high-pressure bottom stream 212 provides at least 70%, at least 75%, at least 80%, at least 85%, at least 90%, or at least 95% of the hydrogen in the two-phase hydroprocessing unit 100. The hydrocarbon feed stream 101, the hydrogen-saturated high-pressure bottom stream 212, or both, may be hydroprocessed in the two-phase hydroprocessing unit 100 to produce the hydroprocessed effluent 111. The hydroprocessed effluent 111 may have a reduced concentration of one or more of metals, nitrogen, sulfur, aromatic compounds, or combinations of these compared to hydrocarbon feed stream 101.

In embodiments, prior to introducing the hydrocarbon feed stream 101 to the two-phase hydroprocessing unit 100, the hydrocarbon feed stream 101 may be heated at the first heat exchanger 300 to produce a heat-exchanged hydrocarbon feed stream 301. The hydroprocessed effluent 111 may be cooled at the first heat exchanger 300.

In embodiments, prior to introducing the hydrocarbon feed stream 101 to the two-phase hydroprocessing unit 100, the hydrocarbon feed stream 101 may be heated at the furnace 400. In embodiments, prior to introducing the hydrocarbon feed stream 101 to the two-phase hydroprocessing unit 100, the hydrocarbon feed 101 may be heated at the first heat exchanger 300 to produce the first heat exchanged hydrocarbon feed stream 301. The first heat exchanged hydrocarbon feed stream 301, the at least a portion of the hydrogen-saturated high-pressure bottom stream 212, or both may be heated at the furnace 400 to produce the heated mixture stream 401. The heated mixture stream 401 may then be introduced to the two-phase hydroprocessing unit 100.

Hydroprocessing the hydrocarbon feed stream 101, the hydrogen-saturated high-pressure bottom stream 212, or both, may occur under conditions that substantially saturate the aromatic species, such that species such as naphthalenes are converted to single ring aromatic compounds. The hydroprocessed effluent 111 may have a greater propensity for cracking to light olefins (C2-C4). The hydroprocessing process may convert unsaturated hydrocarbons, such as olefins and diolefins, to paraffins. Paraffins may easily be cracked to light olefins, compared to unsaturated hydrocarbons. Heteroatoms and contaminant species may also be removed by the hydroprocessing process. These species may include sulfur, nitrogen, oxygen, halides, and certain metals.

The hydroprocessing process may remove sulfur along with metal contaminants, nitrogen, which may help to prolong catalyst activity and reduce Nitrogen Oxide ($NO_x$) emissions during catalyst regeneration. The hydroprocessing process may reduce the amount of polyaromatics which are coke precursors. Feeds with high aromatic content also may act as coke precursors and may have the tendency to produce more coke during catalytic cracking. The hydroprocessing process may convert polyaromatics to mono aromatics, paraffins, naphthenes, or combinations thereof, for easy cracking to light olefins. The hydroprocessing process may maximize light olefins yield.

The two-phase hydroprocessing unit 100 may improve the hydrogen content and suitability of the hydrocarbon feed stream 101 for cracking. The hydroprocessing process may remove one or more of at least a portion of nitrogen, sulfur, and one or more metals from the hydrocarbon feed stream 101, and may additionally break aromatic moieties in the hydrocarbon feed stream 101. According to one or more embodiments, the contents of the hydrocarbon feed stream 101 entering the two-phase hydroprocessing unit 100 may have a relatively large amount of one or more metals (for example, Vanadium, Nickel, or both), sulfur, and nitrogen. For example, the contents of the hydrocarbon feed stream 101 entering the two-phase hydroprocessing unit 100 may comprise one or more of greater than 1 parts per million by weight of metals, greater than 10 parts per million by weight of sulfur, and greater than 50 parts per million by weight of nitrogen. The contents of the hydroprocessed effluent 111 exiting the two-phase hydroprocessing unit 100 may have a relatively small amount of one or more of metals (for example, Vanadium, Nickel, or both), sulfur, and nitrogen. For example, the contents of the hydroprocessed effluent 111 exiting the two-phase hydroprocessing unit 100 may comprise one or more of 17 parts per million by weight of metals or less, 500 parts per million by weight of sulfur or less, and 50 parts per million by weight of nitrogen or less.

The hydrocarbon feed stream 101 may be treated with a hydroprocessing catalyst. In embodiments, the hydroprocessing catalyst may be a hydrodemetalization catalyst, a hydrodesulfurization catalyst, a hydrodenitrogenation catalyst, a hydrocracking catalyst, or combinations thereof. The hydrodemetalization catalyst, the hydrodesulfurization catalyst, the hydrodenitrogenation catalyst, and the hydrocracking catalyst may be positioned in series, either contained in a single reactor, such as a packed bed reactor with multiple beds, or contained in two or more reactors arranged in series.

The hydroprocessing catalyst may comprise one or more metals from the International Union of Pure and Applied Chemistry (IUPAC) Groups 5, 6, or 8-10 of the periodic table. Example IUPAC Group 6 metals include molybdenum and tungsten. Example IUPAC Group 8-10 metals include nickel and cobalt. In one embodiment, the hydroprocessing catalyst may comprise molybdenum and nickel metal catalyst, cobalt and molybdenum metal catalyst, or both. The hydroprocessing catalyst may further comprise a support material, and the metal may be disposed on the support material. The support material may be gamma-alumina or silica/alumina extrudates, spheres, cylinders, beads, pellets, and combinations thereof.

Referring again to FIGS. 1 to 2, the hydroprocessed effluent 111 may be combined with make-up hydrogen 102 downstream of the two-phase hydroprocessing unit 100 to produce a hydrogen-saturated hydroprocessed effluent 321. In embodiments, an amount of the make-up hydrogen 102 may be at least 1 times an amount of the hydrogen consumed in the two-phase hydroprocessing unit 100. In some embodiments, an amount of the make-up hydrogen 102 may be 1 times, 2 times, or 4 times the amount of the hydrogen consumed in the two-phase hydroprocessing unit 100.

Prior to combining the hydroprocessed effluent 111 with the make-up hydrogen 102, the hydroprocessed effluent 111 may be passed through the first heat exchanger 300 to heat the hydrocarbon feed stream 101. In embodiments, the hydroprocessed effluent 111 may be split into two streams and passed to the first heat exchanger 300 and a second heat exchanger 350, where the second heat exchanger 350 can heat the hydrogen-saturated high-pressure bottom stream 212. The first heat exchanger 300, second heat exchanger 350, or both produce a cooled hydroprocessed effluent 311. Prior to combining the make-up hydrogen 102 with the cooled hydroprocessed effluent 311, the make-up hydrogen 102 may be compressed at a make-up hydrogen compressor 510 to produce a compressed make-up hydrogen 511. In embodiments, the make-up hydrogen compressor 510 may have a compressor capacity sufficient to supply an amount of make-up hydrogen 102 equal to 1 times, 2 times, or 4 times the amount of hydrogen consumed in the two-phase hydroprocessing unit 100. The compressed make-up hydrogen 511 may then be combined with the cooled hydroprocessed effluent 311 to produce the hydrogen-saturated hydroprocessed effluent 321.

The hydrogen-saturated hydroprocessed effluent 321 may be separated in a separation system 200 to produce a hydrogen-saturated high-pressure bottom stream 212, a hydroprocessed product stream 224, and a gaseous effluent 223. The gaseous effluent 223 may include a high-pressure gaseous effluent 211, a low-pressure gaseous effluent 221, or both. The hydrogen-saturated high-pressure bottom stream 212 may be saturated with hydrogen dissolved into a liquid phase.

The separation system 200 may include a high-pressure high-temperature separation unit 210 and a high-pressure low-temperature separation unit 220. The high-pressure high-temperature separation unit 210 may be disposed downstream of the two-phase hydroprocessing unit 100. The high-pressure high-temperature separation unit 210 may operate at a temperature of from 220 Celsius (° C.) to 300° C. and a pressure equal to the operating pressure of the two-phase hydroprocessing unit 100 minus pressure losses from the piping and first heat exchanger 300. The high-pressure high-temperature separation unit 210 may operate at a pressure of from 10 bars (1 megapascal (MPa)) to 200 bars (20 MPa). The high-pressure low-temperature separation unit 220 may be disposed downstream from the high-pressure high-temperature separation unit 210. The high-pressure low-temperature separation unit 220 may operate at a temperature of from 40° C. to 80° C. The high-pressure low-temperature separation unit 220 may operate at a pressure of from 10 bars (1 MPa) to 200 bars (20 MPa). The high-pressure low-temperature separation unit 220 may be operated at a pressure equal to the pressure of the high-pressure high-temperature separation unit 210 minus pressure losses.

The hydrogen-saturated hydroprocessed effluent 321 may be passed to the high-pressure high-temperature separation unit 210. The hydrogen-saturated hydroprocessed effluent 321 may be separated into the hydrogen-saturated high-pressure bottom stream 212 and the high-pressure gaseous effluent 211. The high-pressure gaseous effluent 211 may comprise $H_2$, $H_2S$, $NH_3$, hydrogen gas, light hydrocarbons, such as methane, ethane, propane, butanes, or combinations thereof.

A first portion of the hydrogen-saturated high-pressure bottom stream 213 may be passed to the high-pressure low-temperature separation unit 220. The first portion of the hydrogen-saturated high-pressure bottom stream 213 may be separated into the low-pressure gaseous effluent 221 and the hydroprocessed product stream 224. The low-pressure gaseous effluent 221 may comprise $H_2$, $H_2S$, hydrogen gas, light hydrocarbons, such as methane, ethane, propane, butanes, or combinations thereof. The hydroprocessed product stream 224 may include one or more transportation fuel fractions, such as hydrocarbon compounds boiling in the diesel range of from 180° C. to 350° C. In embodiments, the hydroprocessed product stream 224 may have less than 50 ppmw, less than 45 ppmw, less than 40 ppmw, less than 35 ppmw, less than 30 ppmw, less than 25 ppmw, less than 20 ppmw, less than 15 ppmw, or less than 10 ppmw sulfur. In embodiments, the hydroprocessed product stream 224 may have greater than 1 ppmw, greater than 2 ppmw, or greater than 5 ppmw sulfur. The hydroprocessed product stream 224 may be a hydroprocessed feedstock that can be passed to one or more downstream unit operations for further upgrading. The hydroprocessed product stream 224 may be further separated to produce one or more transportation fuel streams, such as diesel fuel, diesel oil, gasoline blending components, or other transportation fuel streams.

At least a portion of the hydrogen-saturated high-pressure bottom stream 212 may be passed back to the two-phase hydroprocessing unit 100. For example, a second portion of the hydrogen-saturated high-pressure bottom stream 214 may be passed back to the two-phase hydroprocessing unit 100. In embodiments, the hydrogen-saturated high-pressure bottom stream 212 provides at least 70%, at least 75%, at least 80%, at least 85%, at least 90%, or at least 95% of the hydrogen in the two-phase hydroprocessing unit 100.

Prior to introducing the at least a portion of the hydrogen-saturated high-pressure bottom stream 212 to the two-phase hydroprocessing unit 100, the at least a portion of the hydrogen-saturated high-pressure bottom stream 212 may be combined with the hydrocarbon feed stream 101 upstream of the two-phase hydroprocessing unit 100. In embodiments, prior to introducing the at least a portion of the hydrogen-saturated high-pressure bottom stream 212 to the two-phase hydroprocessing unit 100, the at least a portion of the hydrogen-saturated high-pressure bottom stream 212 may be combined with the hydrocarbon feed stream 101 to produce a mixed stream 302. In embodiments, the hydrogen-saturated high-pressure bottom stream 212 may be passed through the second heat exchanger 350 to produce a heated hydrogen-saturated bottom stream 351, the hydrocarbon feed stream 101 can be passed through the first heat exchanger 300 to produce a heated hydrocarbon feed stream 301, and the heated hydrocarbon feed stream 301 and the heated hydrogen-saturated bottom stream 351 can be combined to produce the mixed stream 302. In embodiments, the mixture stream 302 comprising the at least a portion of the hydrogen-saturated high-pressure bottom stream 212, the at least a portion of the hydrocarbon feed stream 101, or both, may be further heated at the furnace 400 upstream of the two-phase hydroprocessing unit 100 to produce the heated mixture stream 401.

Still referring to FIGS. 1 and 2, the hydrogen-saturated high-pressure bottom stream 212 may be combined with the hydrocarbon feed stream 101 to produce a mixture stream 302. The mixture stream 302 may be introduced to the furnace 400 upstream of the two-phase hydroprocessing unit 100 to produce the heated mixture stream 401.

Referring again to FIG. 1, the high-pressure gaseous effluent 211 and the low-pressure gaseous effluent 221 may be combined to produce the gaseous effluent 223. In embodiments, prior to combining the low-pressure gaseous effluent 221 with the high-pressure gaseous effluent 211, at least a portion 222 of the low-pressure gaseous effluent 221 may be combined with the make-up hydrogen stream 102. The at least a portion 222 of the low-pressure gaseous effluent 221 may provide supplemental hydrogen into the make-up hydrogen stream 102.

The gaseous effluent 223 may be introduced to a gaseous effluent separation system 600 to produce a hydrogen stream 611 and an impurities stream 612. The gaseous effluent 223 may be purified to produce the hydrogen stream 611. A hydrogen partial pressure in the hydrogen stream 611 may be increased by the purification at the gaseous effluent separation system 600 compared to the gaseous effluent 223. The hydrogen partial pressure in the hydrogen stream 611 may be increased by removing the impurities stream 612 from the gaseous effluent 223. The hydrogen stream 611 having a greater partial pressure of hydrogen may deliver a greater number of hydrogen molecules per unit of flow. In embodiments, the hydrogen stream 611 may have greater than or equal to 85 volume percent (vol. %), greater than or equal to 90 vol. %, greater than or equal to 95 vol. %, greater than or equal to 98 vol. %, greater than or equal to 99 vol. %, greater than or equal to 99.5 vol. %, or greater than or equal to 99.9 vol. % of the hydrogen.

In embodiments, the gaseous effluent separation system 600 may include an amine absorption unit, a gas purification unit, or both. In one embodiment, the amine absorption unit may separate $H_2S$ from the gaseous effluent 223. In one embodiment, the gas purification unit may separate $C_1$-$C_4$ gases from the gaseous effluent 223.

In embodiments, the hydrogen stream 611 from the gaseous effluent separation system 600 may be divided into a recycle hydrogen stream 613 and a hydrogen bleed stream 614. A least a portion of the recycle hydrogen stream 613 may be recycled back to the system 10, such as by being combined with the hydroprocessed effluent 111 downstream of the two-phase hydroprocessing unit 100, by passing a portion of the recycle hydrogen stream 613 back to the two-phase hydroprocessing unit 100, or both. In embodiments, the hydrogen bleed stream 614 may exit to the system 10. In embodiments, the impurities stream 612 may comprise $H_2S$, $C_1$-$C_4$ gases, or both.

In embodiments, at least a portion of the recycle hydrogen stream 613 may be combined with the hydrocarbon feed stream 101, the hydrogen-saturated high-pressure bottom stream 212, or both, upstream of the two-phase hydroprocessing unit 100. In embodiments, prior to combining the recycle hydrogen stream 613 with the hydrocarbon feed stream 101, the hydrogen-saturated high-pressure bottom stream 212, or both, the recycle hydrogen stream 613 may be compressed at a recycle hydrogen compressor 520 to produce the compressed recycle hydrogen stream 521. In embodiments, the recycle hydrogen compressor 520 may have a capacity sufficient to supply enough hydrogen to the heated mixed stream 401 to saturate the heated mixed stream 401 with hydrogen. For example, for a unit capacity of 400,000 kg/h to 800,000 kg/h, consuming hydrogen from 1 wt. % to 2 wt. %, in embodiments, the recycle hydrogen compressor 520 may have a compressor capacity of from 5,000 kg/h to 10,000 kg/h, from 6,000 kg/h to 9,000 kg/h, or from 7,000 kg/h to 8,000 kg/h.

The recycle hydrogen stream 613 may be combined with the hydrocarbon feed stream 101, the hydrogen-saturated high-pressure bottom stream 212, or both, upstream of the two-phase hydroprocessing unit 100. In one embodiment, a first portion of the compressed recycle hydrogen stream 522 may be combined with the hydrocarbon feed stream 101, the hydrogen-saturated high-pressure bottom stream 212, or both, upstream of the two-phase hydroprocessing unit 100 to produce a mixture feed stream 402. The recycle hydrogen stream 613 may be combined with the make-up hydrogen stream 102. In one embodiment, a second portion of the compressed recycle hydrogen stream 523 may be combined with the make-up hydrogen stream 102.

The process of the present disclosure may increase the hydrogen partial pressure by utilizing the two-phase hydroprocessing unit 100 and separation system 200. In particular, the process may increase the recycle hydrogen purity. In embodiments, the recycle hydrogen purity may be greater than or equal to 85 vol. %, greater than or equal to 90 vol. %, greater than or equal to 95 vol. % %, greater than or equal to 98 vol. %, greater than or equal to 99 vol. %, greater than or equal to 99.5 vol. % or greater than or equal to 99.9 vol. %. The conventional processes including three-phase hydroprocessing reactor may have a recycle hydrogen purity of less than 80%. When the conventional hydroprocessing reactor is operated at 40 bars (4 MPa) and conventional process has 70 vol. % recycle hydrogen purity, the hydrogen partial pressure is 28 bars (2.8 MPa). In contrast, the process of the present disclosure may have the hydrogen partial pressure of 39.8 bars (3.98 MPa), when the two-phase hydroprocessing unit is operated at 40 bars (4 MPa) and the process has 99.5 V % recycle hydrogen purity. In other words, the hydrogen partial pressure difference, 42% more hydrogen partial pressure, shows that the process of the present disclosure requires less compressor capacity for recycle hydrogen stream and make-up hydrogen stream compare to the conventional process.

Referring to FIG. 2, the two-phase hydroprocessing unit 100 may include a first reactor 110, a second reactor 120, and a third reactor 130. The hydrocarbon feed stream 101 may be introduced to the first reactor 110 to produce a first reaction effluent 112. The second reactor 120 may be disposed downstream of the first reactor 110. The second reactor 120 may be in fluid communication with the first reactor 110. The first reaction effluent 112 may be introduced to the second reactor 120 to produce a second reaction effluent 122. The third reactor 130 may be disposed downstream of the second reactor 120. The third reactor 130 may be in fluid communication with the second reactor 120. The second reaction effluent 122 may be introduced to the third reactor 130 to produce a third reaction effluent 132. The first reaction effluent 112, the second reaction effluent 122, and the third reaction effluent 132 may have at least 70 wt. % less, at least 80 wt. % less, or even at least 90 wt. % less contaminants compared to the hydrocarbon feed stream 101.

Still referring to FIG. 2, the third reaction effluent 132 may be combined with make-up hydrogen 102 downstream of the two-phase hydroprocessing unit 100 to produce a hydrogen-saturated hydroprocessed effluent 321 Prior to combining the third reaction effluent 132 with the make-up hydrogen 102, the third reaction effluent 132 may be cooled at the first heat exchanger 300 to produce a cooled hydroprocessed effluent 311. Prior to combining the make-up hydrogen 102 with the third reaction effluent 132, the make-up hydrogen 102 may be compressed at a make-up hydrogen compressor 510 to produce a compressed make-up hydrogen 511. In embodiments, the make-up hydrogen compressor 520 can have a capacity sufficient to supply enough hydrogen to the heated mixed stream 401 to saturate the heated mixed stream 401 with hydrogen. For example, For example, for a unit capacity of 400,000 kg/h to 800,000 kg/h, consuming hydrogen from 1 wt. % to 2 wt. %, in embodiments, the make-up hydrogen compressor 510 may have a compressor capacity of from 5,000 kg/h to 10,000 kg/h, from 6,000 kg/h to 9,000 kg/h, or from 7,000 kg/h to 8,000 kg/h. The compressed make-up hydrogen 511 may then be combined with the third reaction effluent 132 to produce the hydrogen-saturated hydroprocessed effluent 321. The hydrogen-saturated hydroprocessed effluent 321 may be separated in a separation system 200 to produce a hydrogen-saturated high-pressure bottom stream 212, a hydroprocessed product stream 224, and a gaseous effluent 223.

The at least a portion of the hydrogen-saturated high-pressure bottom stream 212 may be combined with the at least a portion of the hydrocarbon feed stream 101 to produce a mixture stream 302. In embodiments, at least a portion of the mixture stream 302 may be introduced to the two-phase hydroprocessing unit 100. In one embodiment, a first portion of the mixture stream 303 may be combined with the first reaction effluent 112. At least portion of the first portion of the mixture stream 303, the first reaction effluent 112, or both may be introduced to the second reactor 120. A remaining portion 112A of the first portion of the mixture stream 303, the first reaction effluent 112, or both may be combined with the second reaction effluent 122. In one embodiment, a second portion of the mixture stream 304 may be combined with the second reaction effluent 122. In embodiments, the second portion of the mixture stream 304 may be combined with the second reaction effluent 122, the remaining portion 112A of the first portion of the mixture stream 303, the first reaction effluent 112, or both. At least portion of the second portion of the mixture stream 304, the remaining portion 112A of the first portion of the mixture stream 303, the first reaction effluent 112, or both, the second reaction effluent 122, or combinations thereof, may be introduced to the third reactor 130. A remaining portion 122A of the second portion of the mixture stream 304, the remaining portion 112A of the first portion of the mixture stream 303, the first reaction effluent 112, or both, the second reaction effluent 122, or combinations thereof may be combined with the third reaction effluent 132.

Still referring to FIG. 2, the gaseous effluent 223 may be introduced to a gaseous effluent separation system 600 to produce a hydrogen stream 611 and an impurities stream 612. In embodiments, the hydrogen stream 611 from the gaseous effluent separation system 600 may be divided into a recycle hydrogen stream 613 and a hydrogen bleed stream 614. In embodiments, the recycle hydrogen stream 613 may be combined with the first reaction effluent 112 and the second reaction effluent 122. The recycle hydrogen stream 613 may be combined with the first reaction effluent 112. In one embodiment, a third portion of the compressed hydrogen 531 may be combined with the first reaction effluent 112. The recycle hydrogen stream 613 may be combined with the second reaction effluent 122. In one embodiment, a fourth portion of the compressed hydrogen 532 may be combined with the second reaction effluent 122.

Referring back to FIGS. 1 to 2, embodiments of the present disclosure are also directed to systems for hydroprocessing a hydrocarbon feed stream 101. The system 10 may include the two-phase hydroprocessing unit 100, and a separation system 200. The system 10 may further include a first heat exchanger 300, a furnace 400, a make-up hydrogen compressor 510, a recycle hydrogen compressor 520, and a gaseous effluent separation system 600.

The two-phase hydroprocessing unit 100 may include at least one hydroprocessing catalyst, which may be a solid particulate hydroprocessing catalyst. The two-phase hydroprocessing unit 100 may be operable to contact the hydrocarbon feed stream 101 with hydrogen in the presence at least one solid hydroprocessing catalyst to produce a hydroprocessed effluent 111.

Still referring to FIGS. 1 to 2, the make-up hydrogen stream 102 may be in fluid communication with the hydroprocessed effluent 111. The make-up hydrogen stream 102 may be combined with the hydroprocessed effluent 111 downstream of the two-phase hydroprocessing unit 100 to produce a hydrogen-saturated hydroprocessed effluent 321.

In embodiments, the system 10 may further include the make-up hydrogen compressor 510 upstream of the separation system 200. The make-up hydrogen compressor 510 may be operable to compress the make-up hydrogen 102.

The separation system 200 may be disposed downstream of the two-phase hydroprocessing unit 100. The separation system 200 may be in fluid communication with the two-phase hydroprocessing unit 100. The separation system 200 may include a high-pressure high-temperature separation unit 210 and a high-pressure low-temperature separation unit 220 downstream of the high-pressure high-temperature separation unit 210. The high-pressure high-temperature separation unit 210 may be downstream of the two-phase hydroprocessing unit 100. The high-pressure high-temperature separation unit 210 may be downstream of the make-up hydrogen compressor 510. The high-pressure high-temperature separation unit 210 may be downstream of the first heat exchanger 300. The high-pressure high-temperature separation unit 210 may be operable to separate the hydrogen-saturated hydroprocessed effluent 321 into the hydrogen-saturated high-pressure bottom stream 212 and the high-pressure gaseous effluent 211. The high-pressure high-temperature separation unit 210 may operate at a temperature of from 220° C. to 300° C. and a pressure equal to the operating pressure of the two-phase hydroprocessing unit 100 minus pressure drop losses due to piping and first heat exchanger 300 disposed between the two-phase hydroprocessing unit 100 and the high-pressure high-temperature separation unit 210. The high-pressure high-temperature separation unit 210 may be in fluid communication with the two-phase hydroprocessing unit to pass the at least a portion of the hydrogen-saturated high-pressure bottom stream 212 back to the two-phase hydroprocessing unit 100. The high-pressure low-temperature separation unit 220 may be disposed downstream of the high-pressure high-temperature separation unit 210. The high-pressure low-temperature separation unit 220 may be in fluid communication with the high-pressure high-temperature separation unit 210. The high-pressure low-temperature separation unit 220 may be operable to separate the first portion of the hydrogen-saturated high-pressure bottom stream 213 into the low-pressure gaseous effluent 221 and the hydroprocessed product stream 224. The high-pressure low-temperature separation unit 220 may operate at a temperature of from 40° C. to 80° C. and a pressure similar to that of the high-pressure high-temperature separation unit 210 taking into account pressure drop losses between the two units.

The system 10 may further include a bottom stream recycle line L100. The bottom stream recycle line L100 may be fluidly coupled to the separation system 200 and the two-phase hydroprocessing unit 100. The bottom stream recycle line L100 may be operable to pass at least a portion of the hydrogen-saturated high-pressure bottom stream 212 from the separation system 200 to the two-phase hydroprocessing unit 100. The hydrogen-saturated high-pressure bottom stream 212 may provide at least 70%, at least 75%, at least 80%, at least 85%, at least 90%, or at least 95% of the hydrogen in the two-phase hydroprocessing unit 100.

In embodiments, the system 10 may further include the gaseous effluent separation system 600. The gaseous effluent separation system 600 may be disposed downstream of the separation system 200. The gaseous effluent separation system 600 may be in fluid communication with the separation system 200. The gaseous effluent separation system 600 may be disposed downstream of the high-pressure low-temperature separation unit 220. The gaseous effluent separation system 600 may be in fluid communication with the high-pressure low-temperature separation unit 220. The gaseous effluent separation system 600 may be operable to produce a recycle hydrogen stream 611 and an impurities stream 612. In embodiments, the gaseous effluent separation system 600 may include an amine absorption unit, a gas purification unit, or both.

In embodiments, the system 10 may further include a recycle hydrogen stream line L200. The recycle hydrogen stream 611 may be in fluid communication with the hydrocarbon feed stream 101, the hydrogen-saturated high-pressure bottom stream 212, or both.

In embodiments, the system 10 may further include the recycle hydrogen compressor 520 upstream of the two-phase hydroprocessing unit 100. The recycle hydrogen compressor 520 may be in fluid communication with the two-phase hydroprocessing unit 100. The recycle hydrogen compressor 520 may be disposed downstream of the gas effluent separation system 600. The recycle hydrogen compressor 520 may be operable to produce the compressed recycle hydrogen stream 521.

In embodiments, the system 10 may further include the first heat exchanger 300 upstream of the separation system 200. The first heat exchanger 300 may be disposed downstream of the two-phase hydroprocessing unit 100. The first heat exchanger 300 may be operable to cool the hydroprocessed effluent 111 to produce the cooled hydroprocessed effluent 311. The first heat exchanger 300 may be operable to produce the heat-exchanged hydrocarbon feed stream 301.

In embodiments, the system 10 may further include the furnace 400 upstream of the two-phase hydroprocessing unit 100. The furnace 400 may be in fluid communication with the two-phase hydroprocessing unit 100. The furnace 400 may be operable to heat the hydrocarbon feed stream 101, the hydrogen-saturated high-pressure bottom stream 212, or both prior to passing these streams to the two-phase hydroprocessing unit 100.

In embodiments, the system 10 may further include a second heat exchanger 310. The second heat exchanger 310 may be disposed downstream of the separation system 200. The second heat exchanger 310 may be disposed upstream of the two-phase hydroprocessing unit 100.

The second heat exchanger 310 may be operable to heat the hydrocarbon feed 101 and cool the hydrogen-saturated high-pressure bottom stream 212. In embodiments, the second heat exchanger 310 may be operable to cool the second portion of the hydrogen-saturated high-pressure bottom stream 214.

Referring to FIG. 2, the two-phase hydroprocessing unit 100 may include a first reactor 110, a second reactor 120, and a third reactor 130. The two-phase hydroprocessing unit 100 may further include a hydrocracking reactor downstream of a third reactor 130. The second reactor 120 may be disposed downstream of the first reactor 110. The second reactor 120 may be in fluid communication with the first reactor 110. The third reactor 130 may be disposed downstream of the second reactor 120. The third reactor 130 may be in fluid communication with the second reactor 120.

EXAMPLES

The following example illustrates features of the present disclosure but is not intended to limit the scope of the disclosure.

Comparative Example 1

Figure 3:
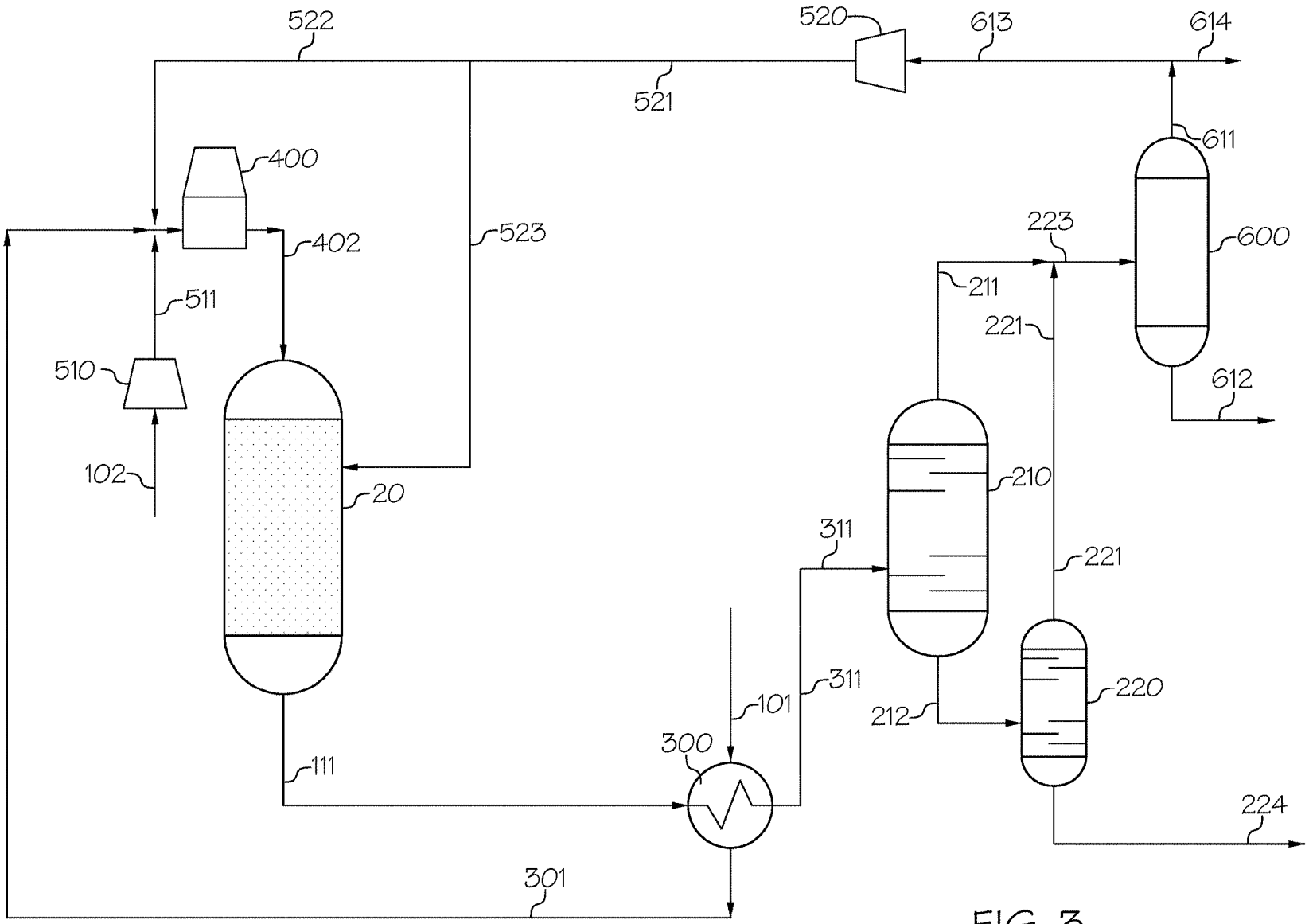
FIG. 3 schematically depicts a generalized flow diagram for the system modeled in Comparative Example 1, according to one or more embodiments shown and described in the present disclosure.

For Comparative Example 1, a hydrocarbon feed 101 comprising a gas oil stream was hydrodesulfurized in a single three-phase hydroprocessing reactor 20 (FIG. 3) to produce a hydroprocessed effluent 111. A process flow diagram for the process of Comparative Example 1 is provided in FIG. 3. A cross-reference of the unit operations and stream names to the corresponding reference numbers in FIG. 3 are provided in Table 2. The hydrocarbon feed 101 was heat-exchanged at the heat-exchanger 300 with the hydroprocessed effluent 111 to produce a heat-exchanged hydrocarbon feed stream 301. The make-up hydrogen 102 was compressed at a make-up hydrogen compressor 510 and then mixed with the heat-exchanged hydrocarbon feed stream 301 downstream of the heat exchanger 300. Composition and property data for the gas oil stream used as the hydrocarbon feed 101 is provided in Table 1.

TABLE 1

Properties of Hydrocarbon Feed 101

| Property/Composition | Value |
|---|---|
| Density (Kg/m$^3$) | 830.4 |
| Initial Boiling Point (° C.) | 173 |
| 5 | — |
| 10 | 217 |
| 30 | 248 |
| 50 | 282 |
| 70 | 318 |
| 85 | 354 |
| 90 | 369 |
| 95 | 385 |
| Final Boiling (° C.) | 416 |
| Sulfur (wt. %) | 1.12 |
| Nitrogen (ppmw) | 175 |
| Aromatic (total wt. %) | 23.5 |
| Mono aromatics (wt. %) | 15.5 |
| Di-aromatics (wt. %) | 6.5 |
| Tri-aromatics (wt. %) | 1.5 |

TABLE 2

Cross-reference of streams and stream numbers to reference numbers in FIG. 3

| | |
|---|---|
| 20 | Three phase hydroprocessing reactor |
| 101 | Hydrocarbon feed |
| 102 | Make-up hydrogen stream |
| 511 | Compressed Make-up hydrogen |
| 111 | Hydroprocessed effluent |
| 210 | High-pressure high-temperature separation unit |
| 211 | High-pressure gaseous effluent |
| 212 | Hydrogen-saturated high-pressure bottom stream |
| 220 | High-pressure low-temperature separation unit |
| 221 | Low-pressure gaseous effluent |
| 224 | Hydroprocessed product stream 224 |
| 300 | Heat exchanger |
| 301 | Heat-exchanged hydrocarbon feed stream |
| 311 | Cooled hydroprocessed effluent |
| 400 | Furnace |
| 402 | Mixture feed stream (combined gas oil stream and hydrogen) |
| 510 | Make-up hydrogen compressor |
| 520 | Recycle hydrogen compressor |
| 521 | Compressed recycle hydrogen stream |
| 522 | First portion of the compressed recycle hydrogen stream |
| 523 | Second portion of the compressed recycle hydrogen stream |
| 600 | Gaseous effluent separation system |
| 611 | Hydrogen stream |
| 613 | Recycle hydrogen stream |

A mixture of the compressed make-up hydrogen 511 and the hydrocarbon feed 101 was heated in the furnace 400 and then provided to the three-phase hydroprocessing reactor 20 with a liquid hourly space velocity of 0.71 $h^{-1}$. The three-phase hydroprocessing reactor 20 was operated at a temperature of 325° C. The hydroprocessed effluent 111 was heat exchanged in the heat exchanger 300 to heat the hydrocarbon feed 101, and the cooled hydroprocessed effluent 311 was passed to the high-pressure high-temperature separation unit 210. The high-pressure high-temperature separation unit 210 was operated at a temperature of 265° C. to produce a high-pressure gaseous effluent 211 and a hydrogen saturated high-pressure bottom stream 212. The hydrogen-saturated high-pressure bottom stream 212 was then passed entirely to the high-pressure low-temperature separation unit 220. The high-pressure low-temperature separation unit 220 was operated at 45° C. to produce a low-pressure gaseous effluent 221 and a hydroprocessed product stream 224 having less than 45 ppmw sulfur. The high-pressure gaseous effluent 211 and the low-pressure gaseous effluent 221 were combined and provided to gaseous effluent separation system 600 to produce a hydrogen stream 611 and impurities stream 612. The hydrogen stream 611 (purified hydrogen) was compressed at a recycle hydrogen compressor 520 and then mixed with the heat-exchanged hydrocarbon feed stream 301 upstream of the furnace 400. A hydrogen (make-up hydrogen and recycle hydrogen) to gas oil ratio was 150 standard liters of hydrogen per liter of gas oil (Std. L/L). The partial pressure of the recycle hydrogen 521 was 49 kg/cm$^2$. Table 3 shows the compositions of the streams in Comparative Example 1. The majority of the sulfur remaining in the streams are dibenzothiophenes. In Comparative Example 1, 1321 Kg/h make-up hydrogen and 4241 Kg/h of recycle hydrogen were needed for the process.

TABLE 3

Stream Compositions (kg/hr) for Comparative Example 1

| Stream No. in FIG. 3 | 101 | 102 | 402 | 111 | 311 | 211 | 212 | 613 | 612 | 522 | 221 | 224 |
|---|---|---|---|---|---|---|---|---|---|---|---|---|
| $H_2$ | — | 1,321 | 5,561 | 4,494 | 4,494 | 4,319 | 4,329 | 5,561 | — | 4,241 | 4,249 | 80 |
| $H_2S$ | — | — | 230 | 3,489 | 3,489 | 3,148 | 4,675 | 230 | — | 230 | 2,549 | 1,979 |
| $NH_3$ | — | — | — | 47 | 47 | 44 | 73 | — | — | — | — | — |
| $H_2O$ | — | — | 142 | 142 | 142 | 126 | 16,596 | 142 | — | 142 | 94 | 43 |
| Methyl Diethanolamine (MDEA) | — | — | — | — | — | — | 1 | — | — | — | — | 1 |
| Methane | — | 597 | 5,784 | 5,834 | 5,834 | 5,521 | 5,793 | 5,784 | — | 5,187 | 5,194 | 599 |
| Ethane | — | 1,119 | 5,111 | 5,160 | 5,160 | 4,551 | 5,764 | 5,111 | — | 3,992 | 3,999 | 1,765 |
| Propane | — | 656 | 2,011 | 2,085 | 2,085 | 1,744 | 3,115 | 2,011 | — | 1,354 | 1,357 | 1,758 |
| I-butane | — | — | 37 | 74 | 74 | 58 | 148 | 37 | — | 37 | 37 | 111 |
| Butane | — | — | 29 | 66 | 66 | 51 | 149 | 29 | — | 29 | 29 | 119 |
| Nitrogen | — | — | — | — | — | — | — | — | — | — | — | — |
| Naphtha | 17,973 | — | 19,543 | 24,968 | 24,968 | 11,855 | 63,828 | 1,570 | — | 1,570 | 1,573 | 62,253 |
| Diesel | 257,076 | — | 257,089 | 249,179 | 249,179 | 15,811 | 96,802 | 14 | — | 14 | 14 | 96,788 |
| Total | 275,048 | 3,694 | 295,537 | 295,538 | 295,538 | 47,228 | 201,273 | 20,488 | — | 16,796 | 19,095 | 165,496 |
| Pressure (bars) | 63.3 | 65.2 | 59.3 | 54 | 53 | 53 | 53 | 65.2 | NA | 65.2 | 49.4 | 49.4 |
| Temp (° C.) | 220.2 | 124.2 | 314.9 | 335.1 | 265 | 265 | 265 | 95.9 | NA | 88.2 | 45 | 45 |

Example 2

Figure 4:
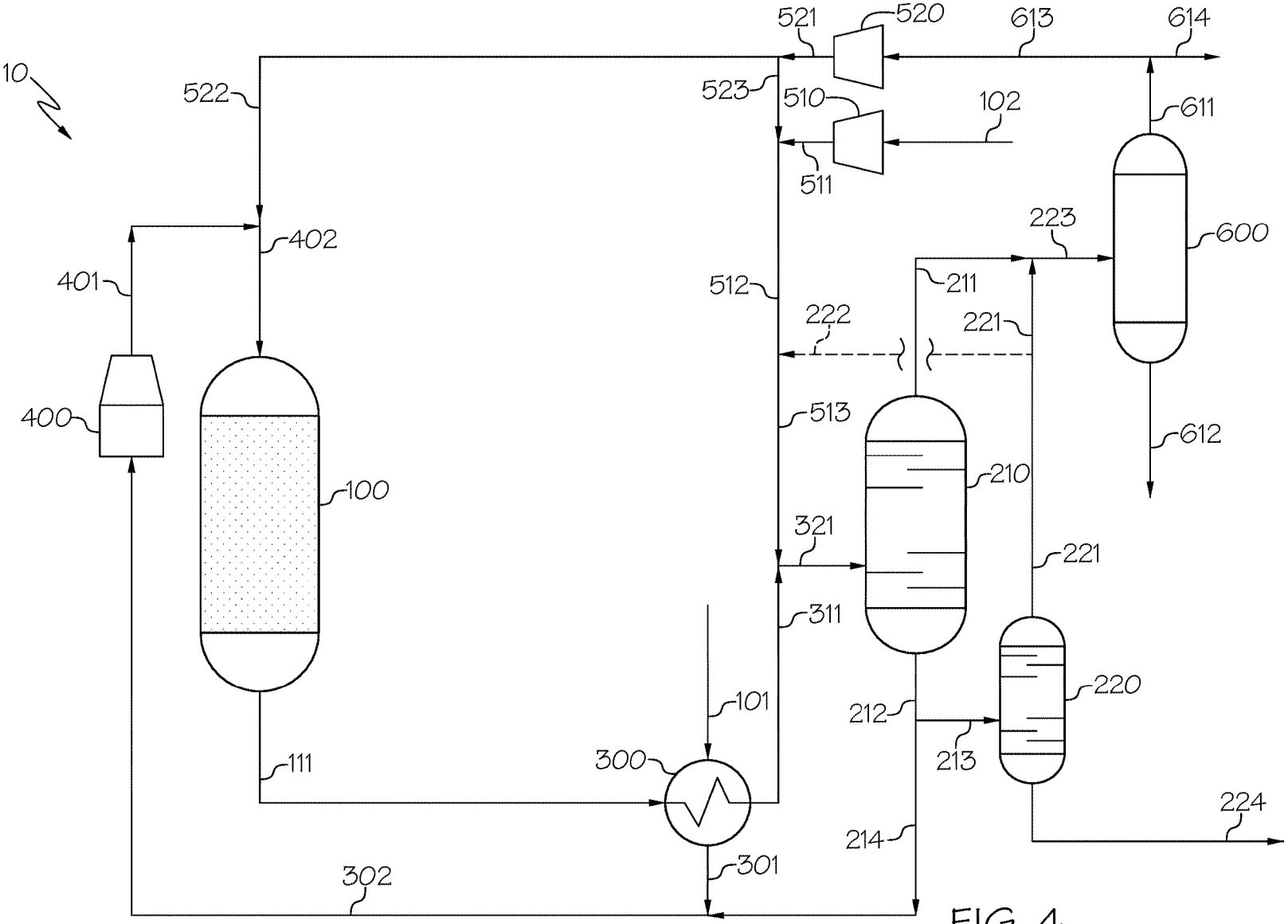
FIG. 4 schematically depicts a generalized flow diagram for the system modeled in Example 2, according to one or more embodiments shown and described in the present disclosure.

For Example 2, a hydrocarbon feed comprising the gas oil having the composition in Table 1 was introduced to the system depicted in FIG. 4 comprising the two-phase hydroprocessing unit 100. A cross-reference of the unit operations and stream names to the corresponding reference numbers in FIG. 4 are provided in Table 4. The hydrocarbon feed 101 was heat-exchanged at the heat-exchanger 300 with the hydroprocessed effluent 111 to produce a heat-exchanged hydrocarbon feed stream 301. The heat-exchanged hydrocarbon feed stream 301 was then combined with a portion of the hydrogen-saturated high-pressure bottoms stream 214 to produce a mixed stream 302. The mixed stream 302 was heated in furnace 400 and then mixed with the first portion of the compressed recycle hydrogen stream 522 upstream of the two-phase hydroprocessing unit 100. Composition and property data for the gas oil stream used as the hydrocarbon feed 101 is provided in Table 1. The hydrocarbon feed 101 was hydrodesulfurized in the two-phase hydroprocessing reactor 100.

TABLE 4

Cross-reference of streams and stream numbers to reference numbers in FIG. 4

| | |
|---|---|
| 100 | Two-phase hydroprocessing reactor |
| 101 | Hydrocarbon feed |
| 102 | Make-up hydrogen stream |
| 111 | Hydroprocessed effluent |
| 210 | High-pressure high-temperature separation unit |
| 211 | High-pressure gaseous effluent |
| 212 | Hydrogen-saturated high-pressure bottom stream |
| 213 | First portion of the hydrogen-saturated high-pressure bottom stream |
| 214 | Second portion of the hydrogen-saturated high-pressure bottom stream |
| 220 | High-pressure low-temperature separation unit |
| 221 | Low-pressure gaseous effluent |
| 222 | A portion of the low-pressure gaseous effluent |
| 223 | Gaseous effluent |
| 224 | Hydroprocessed product stream |
| 300 | Heat exchanger |

TABLE 4-continued

Cross-reference of streams and stream numbers to reference numbers in FIG. 4

| | |
|---|---|
| 301 | Heat exchanged hydrocarbon feed stream |
| 302 | Mixed stream |
| 311 | Cooled hydroprocessed effluent |
| 321 | Cooled hydroprocessed effluent and make-up hydrogen |
| 400 | Furnace |
| 401 | Heated mixed stream |
| 402 | Mixture feed stream (combined gas oil stream and hydrogen) |
| 510 | Make-up hydrogen compressor |
| 511 | Compressed make-up hydrogen |
| 512 | Mixture of compressed make-up hydrogen and second portion of the compressed recycle hydrogen stream |
| 513 | Mixture of compressed make-up hydrogen, second portion of the compressed recycle hydrogen stream, and a portion of the low-pressure gaseous effluent |

TABLE 4-continued

| Cross-reference of streams and stream numbers to reference numbers in FIG. 4 | |
|---|---|
| 520 | Recycle hydrogen compressor |
| 521 | Compressed recycle hydrogen stream |
| 522 | First portion of the compressed recycle hydrogen stream |
| 523 | Second portion of the compressed recycle hydrogen stream |
| 600 | Gaseous effluent separation system |
| 611 | Hydrogen stream |
| 612 | Impurities stream |
| 613 | Recycle hydrogen stream |

The two-phase hydroprocessing reactor 100 was operated at the same operating conditions described above in Comparative Example 1. In particular, the mixture feed stream 402 comprising the heated mixed stream 401 and any recycled hydrogen was passed to the two-phase hydroprocessing unit 100 at a liquid hourly space velocity of 0.71 $h^{-1}$. The two-phase hydroprocessing reactor 100 was operated at a temperature of 325° C. The hydroprocessed effluent 111 was heat exchanged in the heat exchanger 300 to heat the hydrocarbon feed 101, and the cooled hydroprocessed effluent 311 was passed to the high-pressure high-temperature separation unit 210. The high-pressure high-temperature separation unit 210 was operated at a temperature of 265° C. to produce a high-pressure gaseous effluent 211 and a hydrogen saturated high-pressure bottom stream 212. A first portion of the hydrogen-saturated high-pressure bottom stream 213 was then passed entirely to the high-pressure low-temperature separation unit 220. As previously discussed, the second portion of the hydrogen-saturated high-pressure bottom stream 214 was combined with the heated hydrocarbon feed stream 301 to produce the mixed stream 302.

The high-pressure low-temperature separation unit 220 was operated at 45° C. to produce a low-pressure gaseous effluent 221 and a hydroprocessed product stream 224 having less than 45 ppmw sulfur. The high-pressure gaseous effluent 211 and the low-pressure gaseous effluent 221 were combined and provided to gaseous effluent separation system 600 to produce a hydrogen stream 611 and impurities stream 612. The hydrogen stream 611 (purified hydrogen) was compressed at a recycle hydrogen compressor 520 and then mixed with the heat-exchanged hydrocarbon feed stream 301 upstream of the furnace 400.

For Example 2, 715 Kg/h of make-up hydrogen and 606 Kg/h of recycle hydrogen were needed in the two-phase hydroprocessing unit. Compared to Comparative Example 1, Example 2 has a substantial reduction in the make-up hydrogen (45%) and recycle hydrogen (85%) compressor capacity. Table 5 shows the compositions of the streams for Example 2.

TABLE 5

Stream Compositions (kg/hr) for Example 2.

| Stream No. in FIG. 4 | 101 | 102 | 402 | 111 | 311 | 211 | 212 | 613 | 612 | 522 | 221 | 224 |
|---|---|---|---|---|---|---|---|---|---|---|---|---|
| $H_2$ | — | 705 | 5,561 | 4,494 | 4,494 | 4,319 | 4,329 | 5,561 | 606 | 4,241 | 4,249 | 80 |
| $H_2S$ | — | 0 | 230 | 3,489 | 3,489 | 3,148 | 4,675 | 230 | 32.87 | 230 | 2,549 | 1,979 |
| $NH_3$ | — | 0 | — | 47 | 47 | 44 | 73 | — | 0 | — | — | — |
| $H_2O$ | — | 0 | 142 | 142 | 142 | 126 | 16,596 | 142 | 20.31 | 142 | 94 | 43 |
| Methyl Diethanolamine (MDEA) | — | 0 | — | — | — | — | 1 | — | 0 | — | — | 1 |
| Methane | — | 318.92 | 5,784 | 5,834 | 5,834 | 5,521 | 5,793 | 5,784 | 741.31 | 5,187 | 5,194 | 599 |
| Ethane | — | 597.66 | 5,111 | 5,160 | 5,160 | 4,551 | 5,764 | 5,111 | 570.42 | 3,992 | 3,999 | 1,765 |
| Propane | — | 350.39 | 2,011 | 2,085 | 2,085 | 1,744 | 3,115 | 2,011 | 193.53 | 1,354 | 1,357 | 1,758 |
| I-butane | — | 0 | 37 | 74 | 74 | 58 | 148 | 37 | 5.26 | 37 | 37 | 111 |
| Butane | — | 0 | 29 | 66 | 66 | 51 | 149 | 29 | 4.21 | 29 | 29 | 119 |
| Nitrogen | — | 0 | — | — | — | — | — | — | 0 | — | — | — |
| Naphtha | 17,973 | 0 | 19,543 | 24,968 | 24,968 | 11,855 | 63,828 | 1,570 | 224.36 | 1,570 | 1,573 | 62,253 |
| Diesel | 257,076 | 0 | 257,089 | 249,179 | 249,179 | 15,811 | 96,802 | 14 | 1.96 | 14 | 14 | 96,788 |
| Total | 275,048 | 1,972 | 295,537 | 295,538 | 295,538 | 47,228 | 201,273 | 20,488 | 2,400 | 16,796 | 19,095 | 165,496 |
| Pressure (bars) | 63.3 | 65.2 | 59.3 | 54 | 53 | 53 | 53 | 65.2 | 65.2 | 65.2 | 49.4 | 49.4 |
| Temp (° C.) | 220.2 | 124.2 | 314.9 | 335.1 | 265 | 265 | 265 | 95.9 | 88.2 | 88.2 | 45 | 45 |

A first aspect of the present disclosure may be directed to a process for hydroprocessing a hydrocarbon feed, the process comprising: contacting the hydrocarbon feed with hydrogen in the presence of at least one solid hydroprocessing catalyst in a two-phase hydroprocessing unit, where contacting produces a hydroprocessed effluent having a reduced concentration of one or more of metals, nitrogen, sulfur, aromatic compounds, or combinations of these compared to the hydrocarbon feed; combining the hydroprocessed effluent with make-up hydrogen downstream of the two-phase hydroprocessing unit to produce a hydrogen-saturated hydroprocessed effluent; separating the hydrogen-saturated hydroprocessed effluent in a separation system to produce a hydrogen-saturated high-pressure bottom stream, a hydroprocessed product stream, and a gaseous effluent, wherein the hydrogen-saturated high-pressure bottom stream is saturated with hydrogen dissolved into a liquid phase; and passing at least a portion of the hydrogen-saturated high-pressure bottom stream back to the two-phase hydroprocessing unit, where the hydrogen-saturated high-pressure bottom stream provides at least 70% of the hydrogen in the two-phase hydroprocessing unit.

A second aspect of the present disclosure may include the first aspect, wherein the hydrocarbon feed comprises an atmospheric distillate, a vacuum distillate, or both.

A third aspect of the present disclosure may include either one of the first or second aspects, wherein the hydroprocessed product stream comprises diesel oil.

A fourth aspect of the present disclosure may include any one of the first through third aspects, wherein the diesel oil has less than 50 ppmw sulfur, or less than 10 ppmw sulfur.

A fifth aspect of the present disclosure may include any one of the first through fourth aspects, further comprising combining the hydrogen-saturated high-pressure bottom stream with the hydrocarbon feed upstream of the two-phase hydroprocessing unit.

A sixth aspect of the present disclosure may include any one of the first through fifth aspects, further comprising heat exchanging the hydrocarbon feed prior to combining the hydrocarbon feed with the hydrogen-saturated high-pressure bottom stream.

A seventh aspect of the present disclosure may include any one of the first through sixth aspects, further comprising heating the hydrocarbon feed, the hydrogen-saturated hydroprocessed effluent, or both upstream of the two-phase hydroprocessing unit.

An eighth aspect of the present disclosure may include any one of the first through seventh aspects, wherein separating the hydrogen-saturated hydroprocessed effluent comprises: passing the hydrogen-saturated hydroprocessed effluent to a high-pressure high-temperature separation unit; separating the hydrogen-saturated hydroprocessed effluent into the hydrogen-saturated high-pressure bottom stream and a high-pressure gaseous effluent; passing a first portion of the hydrogen-saturated high-pressure bottom stream to a high-pressure low-temperature separation unit; separating the first portion of the hydrogen-saturated high-pressure bottom stream into a low-pressure gaseous effluent and the hydroprocessed product stream; and passing a second portion of the hydrogen-saturated high-pressure bottom stream back to the two-phase hydroprocessing unit.

A ninth aspect of the present disclosure may include any one of the first through eighth aspects, wherein the high-pressure high-temperature separation unit operates at a temperature of from 220° C. to 300° C.

A tenth aspect of the present disclosure may include any one of the first through ninth aspects, wherein the high-pressure low-temperature separation unit operates at a temperature of from 40° C. to 80° C.

An eleventh aspect of the present disclosure may include any one of the first through tenth aspects, further comprising: combining the high-pressure gaseous effluent and the low-pressure gaseous effluent to produce the gaseous effluent; and separating the gaseous effluent in a gaseous effluent separation system to produce a recycle hydrogen stream and an impurities stream.

A twelfth aspect of the present disclosure may include any one of the first through eleventh aspects, further comprising separating the gaseous effluent in the gaseous effluent separation system comprising an amine absorption unit, a gas purification unit, or both.

A thirteenth aspect of the present disclosure may include any one of the first through twelfth aspects, further comprising compressing the make-up hydrogen prior to combining the make-up hydrogen with the hydroprocessed effluent.

A fourteenth aspect of the present disclosure may include any one of the first through thirteenth aspects, further comprising combining a recycle hydrogen with the hydrocarbon feed, the hydrogen-saturated high-pressure bottom stream, or both, upstream of the two-phase hydroprocessing unit.

A fifteenth aspect of the present disclosure may include any one of the first through fourteenth aspects, wherein each of the hydrocarbon feed and the hydrogen-saturated high-pressure bottom stream is in a liquid phase at the two-phase hydroprocessing unit.

A sixteenth aspect of the present disclosure may include any one of the first through fifteenth aspects, wherein a volume ratio of the hydrocarbon feed to the hydrogen-saturated high-pressure bottom stream is from 1 to 10.

A seventeenth aspect of the present disclosure may include any one of the first through sixteenth aspects, wherein an amount of the make-up hydrogen is at least 1 time of an amount of the hydrogen consumed in the two-phase hydroprocessing unit.

An eighteenth aspect of the present disclosure may be directed to a system for hydroprocessing a hydrocarbon feed to produce a transportation fuel, the system comprising: a two-phase hydroprocessing unit comprising at least one solid hydroprocessing catalyst, where the two-phase hydroprocessing unit is operable to contact the hydrocarbon feed with hydrogen in the presence the at least one solid hydroprocessing catalyst to produce a hydroprocessed effluent having a reduced concentration of one or more of metals, nitrogen, sulfur, aromatic compounds, or combinations of these compared to the hydrocarbon feed; a make-up hydrogen stream in fluid communication with the hydroprocessed effluent, where the make-up hydrogen stream is combined with the hydroprocessed effluent downstream of the two-phase hydroprocessing unit to produce a hydrogen-saturated hydroprocessed effluent; and a separation system downstream of the two-phase hydroprocessing unit, where the separation system is operable to separate the hydrogen-saturated hydroprocessed effluent to produce a hydrogen-saturated high-pressure bottom stream, a hydroprocessed product stream, and a gaseous effluent, wherein the hydrogen-saturated high-pressure bottom stream is saturated with hydrogen dissolved into a liquid phase, and a bottom stream recycle line fluidly coupled to the separation system and to an inlet of the two-phase hydroprocessing unit, where the bottom stream recycle line is operable to pass at least a portion of the hydrogen-saturated high-pressure bottom stream from the separation system to the two-phase hydroprocessing unit, and the hydrogen-saturated high-pressure bottom stream provides at least 70% of the hydrogen in the two-phase hydroprocessing unit.

A nineteenth aspect of the present disclosure may include the eighteenth aspect, wherein the system further comprises a make-up hydrogen compressor upstream of the separation system, where the make-up hydrogen compressor is operable to compress the make-up hydrogen.

A twentieth aspect of the present disclosure may include either the eighteenth aspect or the nineteenth aspect, wherein the separation system comprises: a high-pressure high-temperature separation unit downstream of the two-phase hydroprocessing unit, where the high-pressure high-temperature separation unit is operable to separate the hydrogen-saturated hydroprocessed effluent into the hydrogen-saturated high-pressure bottom stream and a high-pressure gaseous effluent; and a high-pressure low-temperature separation unit downstream of the high-pressure high-temperature separation unit, where the high-pressure low-temperature separation unit is operable to separate a first portion of the hydrogen-saturated high-pressure bottom stream to produce a low-pressure gaseous effluent and the hydroprocessed product stream.

A twenty-first aspect of the present disclosure may include any one of the eighteenth through twentieth aspects, wherein a recycle hydrogen stream in fluid communication with the hydrocarbon feed, the hydrogen-saturated high-pressure bottom stream, or both.

A twenty-second aspect of the present disclosure may include any one of the eighteenth through twenty-first aspects, wherein the system further comprises a first heat exchanger downstream of the two-phase hydroprocessing unit and upstream of the separation system, where the first heat exchanger is operable to heat the hydrocarbon feed and cool the hydroprocessed effluent.

A twenty-third aspect of the present disclosure may include any one of the eighteenth through twenty-second aspects, the system further comprises a second heat exchanger downstream of the separation system and upstream of the two-phase hydroprocessing unit, where the second heat exchanger is operable to heat the hydrocarbon feed and cool the hydrogen-saturated high-pressure bottom stream.

A twenty-fourth aspect of the present disclosure may include any one of the eighteenth through twenty-third aspects, wherein the system further comprises a furnace upstream of the two-phase hydroprocessing unit, where the furnace is operable to heat the hydrocarbon feed, the at least a portion of the hydrogen-saturated high-pressure bottom stream, or both.

It is noted that one or more of the following claims utilize the terms "where" or "in which" as transitional phrases. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

It should be understood that any two quantitative values assigned to a property may constitute a range of that property, and all combinations of ranges formed from all stated quantitative values of a given property are contemplated in this disclosure.

The subject matter of the present disclosure has been described in detail and by reference to specific embodiments. It should be understood that any detailed description of a component or feature of an embodiment does not necessarily imply that the component or feature is essential to the particular embodiment or to any other embodiment. Further, it should be apparent to those skilled in the art that various modifications and variations can be made to the described embodiments without departing from the spirit and scope of the claimed subject matter.

What is claimed is:

1. A process for hydroprocessing a hydrocarbon feed, the process comprising:

contacting the hydrocarbon feed with hydrogen in the presence of at least one solid hydroprocessing catalyst in a two-phase hydroprocessing unit, where contacting produces a hydroprocessed effluent having a reduced concentration of one or more of metals, nitrogen, sulfur, aromatic compounds, or combinations of these compared to the hydrocarbon feed;

combining the hydroprocessed effluent with make-up hydrogen downstream of the two-phase hydroprocessing unit to produce a hydrogen-saturated hydroprocessed effluent;

separating the hydrogen-saturated hydroprocessed effluent in a separation system to produce a hydrogen-saturated high-pressure bottom stream, a hydroprocessed product stream, and a gaseous effluent, wherein the hydrogen-saturated high-pressure bottom stream is saturated with hydrogen dissolved into a liquid phase; and passing at least a portion of the hydrogen-saturated high-pressure bottom stream back to the two-phase hydroprocessing unit, where the hydrogen-saturated high-pressure bottom stream provides at least 70% of the hydrogen in the two-phase hydroprocessing unit.

2. The process of claim 1, wherein the hydrocarbon feed comprises an atmospheric distillate, a vacuum distillate, or both.

3. The process of claim 1, wherein the hydroprocessed product stream comprises diesel oil having a boiling point temperature range of from 180° C. to 350° C.

4. The process of claim 3, wherein the diesel oil has less than 45 parts per million by weight (ppmw) sulfur.

5. The process of claim 1, further comprising combining the hydrogen-saturated high-pressure bottom stream with the hydrocarbon feed upstream of the two-phase hydroprocessing unit.

6. The process of claim 5, further comprising heating the hydrocarbon feed, the hydrogen-saturated hydroprocessed effluent, or both upstream of the two-phase hydroprocessing unit.

7. The process of claim 1, wherein separating the hydrogen-saturated hydroprocessed effluent comprises:

passing the hydrogen-saturated hydroprocessed effluent to a high-pressure high-temperature separation unit;

separating the hydrogen-saturated hydroprocessed effluent into the hydrogen-saturated high-pressure bottom stream and a high-pressure gaseous effluent;

passing a first portion of the hydrogen-saturated high-pressure bottom stream to a high-pressure low-temperature separation unit;

separating the first portion of the hydrogen-saturated high-pressure bottom stream into a low-pressure gaseous effluent and the hydroprocessed product stream; and passing a second portion of the hydrogen-saturated high-pressure bottom stream back to the two-phase hydroprocessing unit.

8. The process of claim 7, wherein the high-pressure high-temperature separation unit operates at a temperature of from 220 Celsius (° C.) to 300° C.

9. The process of claim 7, wherein the high-pressure low-temperature separation unit operates at a temperature of from 40° C. to 80° C.

10. The process of claim 7, further comprising:

combining the high-pressure gaseous effluent and the low-pressure gaseous effluent to produce the gaseous effluent; and separating the gaseous effluent in a gaseous effluent separation system to produce a recycle hydrogen stream and an impurities stream.

11. The process of claim 10, further comprising separating the gaseous effluent in the gaseous effluent separation system comprising an amine absorption unit, a gas purification unit, or both.

12. The process of claim 1, further comprising compressing the make-up hydrogen prior to combining the make-up hydrogen with the hydroprocessed effluent.

13. The process of claim 1, further comprising combining a recycle hydrogen with the hydrocarbon feed, the hydrogen-saturated high-pressure bottom stream, or both, upstream of the two-phase hydroprocessing unit.

14. The process of claim 1, wherein each of the hydrocarbon feed and the hydrogen-saturated high-pressure bottom stream is in a liquid phase at the two-phase hydroprocessing unit.

15. The process of claim 1, wherein a volume ratio of the hydrocarbon feed to the hydrogen-saturated high-pressure bottom stream is from 1 to 10.

16. The process of claim 1, wherein an amount of the make-up hydrogen is at least 1 time of an amount of the hydrogen consumed in the two-phase hydroprocessing unit.

17. A system for hydroprocessing a hydrocarbon feed to produce a transportation fuel, the system comprising:

a two-phase hydroprocessing unit comprising at least one solid hydroprocessing catalyst, where the two-phase hydroprocessing unit is operable to contact the hydrocarbon feed with hydrogen in the presence the at least one solid hydroprocessing catalyst to produce a hydroprocessed effluent having a reduced concentration of one or more of metals, nitrogen, sulfur, aromatic compounds, or combinations of these compared to the hydrocarbon feed;

a make-up hydrogen stream in fluid communication with the hydroprocessed effluent, where the make-up hydrogen stream is combined with the hydroprocessed effluent downstream of the two-phase hydroprocessing unit to produce a hydrogen-saturated hydroprocessed effluent; and a separation system downstream of the two-phase hydroprocessing unit, where the separation system is operable to separate the hydrogen-saturated hydroprocessed effluent to produce a hydrogen-saturated high-pressure bottom stream, a hydroprocessed product stream, and a gaseous effluent, wherein the hydrogen-saturated high-pressure bottom stream is saturated with hydrogen dissolved into a liquid phase, and a bottom stream recycle line fluidly coupled to the separation system and to an inlet of the two-phase hydroprocessing unit, where the bottom stream recycle line is operable to pass at least a portion of the hydrogen-saturated high-pressure bottom stream from the separation system to the two-phase hydroprocessing unit, and the hydrogen-saturated high-pressure bottom stream provides at least 70% of the hydrogen in the two-phase hydroprocessing unit.

18. The system of claim 17, wherein the separation system comprises:

a high-pressure high-temperature separation unit downstream of the two-phase hydroprocessing unit, where the high-pressure high-temperature separation unit is operable to separate the hydrogen-saturated hydroprocessed effluent into the hydrogen-saturated high-pressure bottom stream and a high-pressure gaseous effluent; and a high-pressure low-temperature separation unit downstream of the high-pressure high-temperature separation unit, where the high-pressure low-temperature separation unit is operable to separate a first portion of the hydrogen-saturated high-pressure bottom stream to produce a low-pressure gaseous effluent and the hydroprocessed product stream.

19. The system of claim 17, wherein a recycle hydrogen stream in fluid communication with the hydrocarbon feed, the hydrogen-saturated high-pressure bottom stream, or both.

20. The system of claim 17, wherein the system further comprises:

a first heat exchanger downstream of the two-phase hydroprocessing unit and upstream of the separation system, where the first heat exchanger is operable to heat the hydrocarbon feed and cool the hydroprocessed effluent; and a second heat exchanger downstream of the downstream of the two-phase hydroprocessing unit and parallel with the first heat exchanger, where the second heat exchanger is operable to heat the heat the hydrogen-saturated high-pressure bottom stream and cool the hydroprocessed effluent.

* * * * *